US010467865B2

(12) United States Patent
Gilmore

(10) Patent No.: US 10,467,865 B2
(45) Date of Patent: Nov. 5, 2019

(54) GAMING DEVICE AND METHODS OF ALLOWING A PLAYER TO PLAY A GAME HAVING PERSISTENT PLAYER POSITIONS

(71) Applicant: Konami Gaming, Inc., Las Vegas, NV (US)

(72) Inventor: Jason Gilmore, Las Vegas, NV (US)

(73) Assignee: Konami Gaming Inc., Las Vegas, NV (US)

( * ) Notice: Subject to any disclaimer, the term of this patent is extended or adjusted under 35 U.S.C. 154(b) by 169 days.

(21) Appl. No.: 14/848,072

(22) Filed: Sep. 8, 2015

(65) Prior Publication Data

US 2016/0086426 A1 Mar. 24, 2016

(30) Foreign Application Priority Data

Sep. 18, 2014 (AU) ..... 2014-227500

(51) Int. Cl.
*G07F 17/32* (2006.01)
*G07F 17/34* (2006.01)

(52) U.S. Cl.
CPC ..... *G07F 17/34* (2013.01); *G07F 17/3244* (2013.01); *G07F 17/3267* (2013.01)

(58) Field of Classification Search
CPC ... G07F 17/3244; G07F 17/34; G07F 17/3267
See application file for complete search history.

(56) References Cited

U.S. PATENT DOCUMENTS 6,315,660 B1 * 11/2001 DeMar ..... G07F 17/32 273/138.2
6,364,314 B1 * 4/2002 Canterbury ..... A63F 3/00157 273/141 A
6,406,369 B1 * 6/2002 Baerlocher ..... G07F 17/3244 463/16

(Continued)

OTHER PUBLICATIONS

"The Silicon Gaming Odyssey Slot Machine" (Levinthal, et al., 1063-6390/97, 1997, IEEE Xplore database).*

(Continued)

*Primary Examiner* — David L Lewis
*Assistant Examiner* — Matthew D Hoel
(74) *Attorney, Agent, or Firm* — Howard & Howard Attorneys PLLC

(57) ABSTRACT

A gaming device for providing an award to a player is described herein. The gaming device displays a primary game including a plurality of reels and a plurality of symbols displayed with reels, generates an outcome of the primary game, and provides a primary award as a function of the outcome. The gaming device detects a triggering condition occurring with the primary game and responsively displays a secondary game including a game board having a plurality of paths and a plurality of position locations defined along each of the plurality of paths. The gaming device determines a current player position within the game board and responsively displays a player symbol at the current player position. The current player position is associated with one of the plurality of position locations and is indicative of a previous position location of the player symbol at a completion of a previous secondary game.

20 Claims, 8 Drawing Sheets

(56) References Cited

U.S. PATENT DOCUMENTS 6,482,089 B2 * 11/2002 DeMar ..... G07F 17/32 273/143 R
6,517,432 B1 * 2/2003 Jaffe ..... G07F 17/32 463/16
6,551,187 B1 * 4/2003 Jaffe ..... G07F 17/32 463/16
6,585,591 B1 * 7/2003 Baerlocher ..... G07F 17/32 463/25
6,648,754 B2 * 11/2003 Baerlocher ..... G07F 17/32 463/12
6,719,632 B2 * 4/2004 Palmer ..... G07F 17/32 463/20
6,908,383 B2 * 6/2005 Baerlocher ..... G07F 17/32 273/138.2
6,918,832 B2 * 7/2005 Baerlocher ..... G07F 17/34 463/20
6,988,947 B2 * 1/2006 Baerlocher ..... G07F 17/32 463/16
7,229,350 B2 * 6/2007 Baerlocher ..... G07F 17/32 273/143 R
7,235,011 B2 * 6/2007 Randall ..... G07F 17/32 463/25
7,273,415 B2 * 9/2007 Cregan ..... G07F 17/32 463/16
7,335,102 B2 * 2/2008 Baerlocher ..... G07F 17/32 463/16
7,361,086 B2 * 4/2008 Gazdic ..... G07F 17/32 273/138.1
7,364,507 B2 * 4/2008 Baerlocher ..... G07F 17/32 273/138.1
7,371,170 B2 * 5/2008 Cregan ..... G07F 17/3265 273/138.1
7,407,435 B2 * 8/2008 Baerlocher ..... G07F 17/32 463/16
7,494,415 B2 * 2/2009 Nakajima ..... G07F 17/32 463/15
7,578,735 B2 * 8/2009 Frizzell ..... G07F 17/3265 273/138.1
7,892,092 B2 2/2011 Matthews et al.
2002/0010018 A1 * 1/2002 Lemay ..... G07F 17/32 463/20
2003/0119581 A1 6/2003 Cannon et al.
2006/0223611 A1 * 10/2006 Baerlocher ..... G07F 17/34 463/16
2007/0149270 A1 * 6/2007 Baerlocher ..... G07F 17/34 463/16
2009/0124346 A1 5/2009 Baerlocher
2012/0122531 A1 5/2012 Aoki et al.
2013/0079108 A1 3/2013 Lafky et al.

OTHER PUBLICATIONS

Patent Examination Report No. 2 (AU 2014227500; O/R); dated Jul. 20, 2016.
Australian Patent Examination Report No. 1 for Patent Application No. 2014227500 dated Oct. 30, 2015.

* cited by examiner

GAMING DEVICE AND METHODS OF ALLOWING A PLAYER TO PLAY A GAME HAVING PERSISTENT PLAYER POSITIONS

CROSS REFERENCE TO RELATED APPLICATION

This application claims priority to Australian Patent Application No. 2014-227500, filed Sep. 18, 2014, the disclosure of which is hereby incorporated by reference in its entirety.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to gaming machines and more particularly, to gaming machines and method for allowing a player to play a game having persistent player positions.

BACKGROUND OF THE INVENTION

Known gaming devices include a video display device to display a reel game that includes a plurality of reels with each reel including a plurality of symbols. During game play, the gaming device accepts a wager from a player, the player selects one or more paylines, the gaming device spins the reels, and sequentially stops each reel to display a combination of symbols on the reels. The gaming device then awards the player an award based on the combination of symbols orientated along the selected payline.

At least some known gaming devices include bonus feature games that may include additional free spins and/or progressive awards. Known gaming machines may include mystery bonus feature games that require the gaming machine to randomly select a bonus game number from a range of numbers, track each wager, increment a total wager amount based on each received wager, and initiate the bonus feature game when the total wager amount equals the bonus game number.

Overtime, players may become frustrated with known bonus feature games because the bonus feature games have limited player interaction and affect on the game outcome. In addition, at least some of the players are not eligible to receive the jackpot and each subsequent players success in obtaining the jackpot is based on the wagers of previous players. Accordingly, new features are necessary to appeal to player interest and enhance excitement in order to entice longer play and increased profitability. The present invention is directed to satisfying these needs.

SUMMARY OF THE INVENTION

In one aspect of the present invention, a gaming device for providing an award to a player is provided. The gaming device includes a display device for displaying a game, a user input device for receiving input from a player, and a controller coupled to the display device and the user input device. The controller is configured to display a primary game on the display device including a plurality of reels and a plurality of symbols being displayed with the plurality of reels. The controller randomly generates an outcome of the primary game, displays the outcome on the display device, and provides a primary award as a function of the outcome. The controller also detects a triggering condition occurring with the primary game and responsively displays a secondary game including a game board having a plurality of paths and a plurality of position locations defined along each of the plurality of paths. The controller determines a current player position within the game board and responsively displays a player symbol at the current player position. The current player position is associated with one of the plurality of position locations and is indicative of a previous position location of the player symbol at a completion of a previous secondary game.

In another aspect of the present invention, a method of providing an award to a player is provided. The method includes the steps of receiving a wager from a player and responsively displaying a primary game on a display device. The primary game includes a plurality of reels and a plurality of symbols being displayed with the plurality of reels. The method includes randomly generating an outcome of the primary game, displaying the outcome on the display device, and providing a primary award as a function of the outcome and the wager. The method also includes detecting a triggering condition occurring with the primary game and responsively displaying a secondary game including a game board having a plurality of paths and a plurality of position locations defined along each of the plurality of paths. The method includes determining a current player position within the game board and responsively displaying a player symbol at the current player position. The current player position is associated with one of the plurality of position locations and is indicative of a previous position location of the player symbol at a completion of a previous secondary game.

In yet another aspect of the present invention, one or more non-transitory computer-readable storage media, having computer-executable instructions embodied thereon, is provided. The computer-executable instructions cause a processor to display a primary game on a display device including a plurality of reels and a plurality of symbols being displayed with the plurality of reels, randomly generate an outcome of the primary game, display the outcome on the display device, and provide a primary award as a function of the outcome. The processor detects a triggering condition occurring with the primary game and responsively displays a secondary game including a game board having a plurality of paths and a plurality of position locations defined along each of the plurality of paths, determines a current player position within the game board, and displays a player symbol at the current player position. The current player position is associated with one of the plurality of position locations and is indicative of a previous position location of the player symbol at a completion of a previous secondary game.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
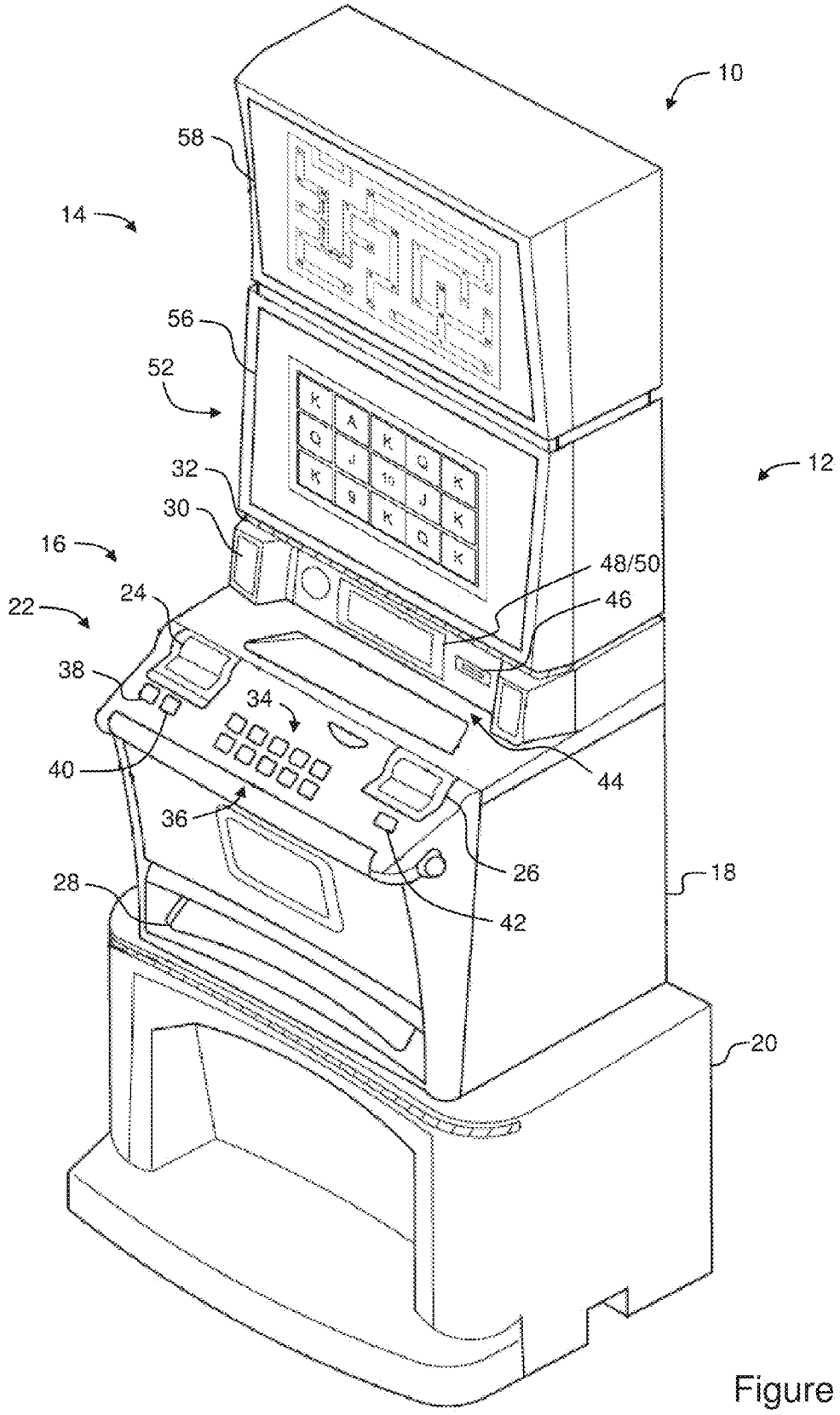
FIG. 1 is a perspective view of an exemplary gaming device for use in providing an award to a player, according to an embodiment of the present invention.

With reference to the drawings and in operation, the present invention overcomes at least some of the disadvantages of known gaming systems by providing a gaming machine that provides a bonus game that allows a player to interact with a player symbol to select one or more bonus awards and that increased the probability of winning an award by providing persistent player positions with subsequent bonus games. Moreover, the gaming machine provides a game that includes a plurality of game symbols positioned throughout a game maze and allows a player to move a player symbol through the game maze to acquire game symbols. The gaming machine also provides an award to the player as a function of the acquired game symbols. In addition, upon completion of the bonus game, the gaming machine stores the current location of the player symbol for use in a subsequent bonus game. By providing a bonus game that includes a plurality of game symbols that are acquired by the player to obtain associated awards, and that stores the location of the corresponding player symbol for use in subsequent games, the probability of the player receiving an award is increased. Thus, the amount of time that the gaming devices are played by patrons of a gaming establishment is thereby increased.

In general, present invention includes a gaming device that is configured to provide a primary base game and a secondary bonus game. The secondary bonus game is mystery triggered, meaning it can occur after any bought base game. When triggered, the game device displays a transition screen to the bonus game displays the bonus game including player character being displayed on a virtual game board. The players start the bonus on the virtual game board shown from the perspective of a "top down" view. The player's character is shown on the board in the center of a bottom screen. Directional arrows are shown around the character (only in the directions in which the character can move). When players select a direction to move their character on the game board, the board dynamically scrolls with a short delay either left, right, up, or down so the player's character is always nearly centered on the screen. One of the following events is shown to the player during or after the character moves: 1) discover an artifact/treasure, awards credits, and continue play; 2) discover a trap and end bonus game; and 3) discover an enemy and trigger jackpot decision bonus feature. The Discover an Artifact/Treasure includes a quick animation of the object appearing on the game board shows along with a winning amount of credits. Credits are then counted in the bonus meter and players select another game board location to move to. Discover a Trap. Finding a trap and playing a short animation that shows the player that the bonus round has ended. The last position on the game board that the player's character was located in is saved and used as the starting point for when the next mystery bonus game is triggered. A quick flame transition then brings the player back to the primary game screen.

Discover an Enemy: when a monster is discovered, a progressive jackpot win is guaranteed. The last position on the game board that the player's character was located in is saved and used as the starting point for when the next mystery bonus game is triggered. The game transitions to a battle scene where the player's character must fight an enemy. Losing against the enemy ends the fighting portion of the bonus and sends the player to the Jackpot Decision bonus. Defeating a enemy awards an upgrade that is applied to the Jackpot Decision bonus. When fighting an enemy, one roll of a pair of dice occurs. The value that the player rolls must tie or exceed the value the enemy has in order to win. The enemy has a predetermined value (number); the higher the number, the more difficult it is to defeat the enemy. Defeating the enemy awards an upgrade and triggers another battle where the above process is repeated with a different monster. The longer the player is in the fighting portion of the bonus, the more the player collects upgrades to be used in the Jackpot Decision bonus.

Jackpot Decision Bonus. This bonus actually occurs simultaneously with the enemy fighting bonus, but it is secondary until the player is defeated by an enemy. When players are fighting an enemy, they will likely notice the colored bonus prize "wheel" on the battle floor. This is the progressive wheel and contains all possible winning values in the progressive decision game. When players defeat an enemy, the progressive wheel will upgrade. The upgrade will be visually shown to the player. Players continue bonus play against enemies, and the progressive wheel will upgrade every time they defeat an enemy; they will visually be able to tell that their potential ending prize is increased. Play continues until the player is defeated by an enemy.

When defeated by an enemy, the enemy disappears and the camera view changes to a top-down view of the floor; a wheel pointer appears and the progressive wheel then "activates" and spins, slowing to a stop. The progressive level prize the pointer points to is awarded to the player and short celebration plays; the bonus game then ends.

Saving game board position—initial game play setup. During a first bonus event, a player moves a character on a game board to various position locations, such as positions A, B, C, and D on the game board. When the first bonus event ends, the current player location, i.e. location D is stored for use in a subsequent bonus game. When the next bonus event is triggered, after n number of games later, the player starts the bonus with the character at position 'D' (from the previous bonus) on the game board and continues the bonus from that point onward. The only persistent state function in the game would be where the player starts the bonus on the game board; nothing else. Each bonus event may be completely independent, meaning, prizes/events on the game board are not held consistently between bonus events (though the same prize could end up at the same location via randomness). Each time the game board event is triggered, the prizes/events populate the game board at random. Therefore, every bonus event (aside from the player's starting position) is completely independent of the prior bonus event.

In addition, the game symbols indicative of potential bonus outcomes change locations in some instances and some remaining in the same location. This is a result of the random population of bonus outcome symbols on the game board. In addition, at least some game symbols may represent several different prize values (for example: 100, 250, 300, or 500 credits).

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 2:
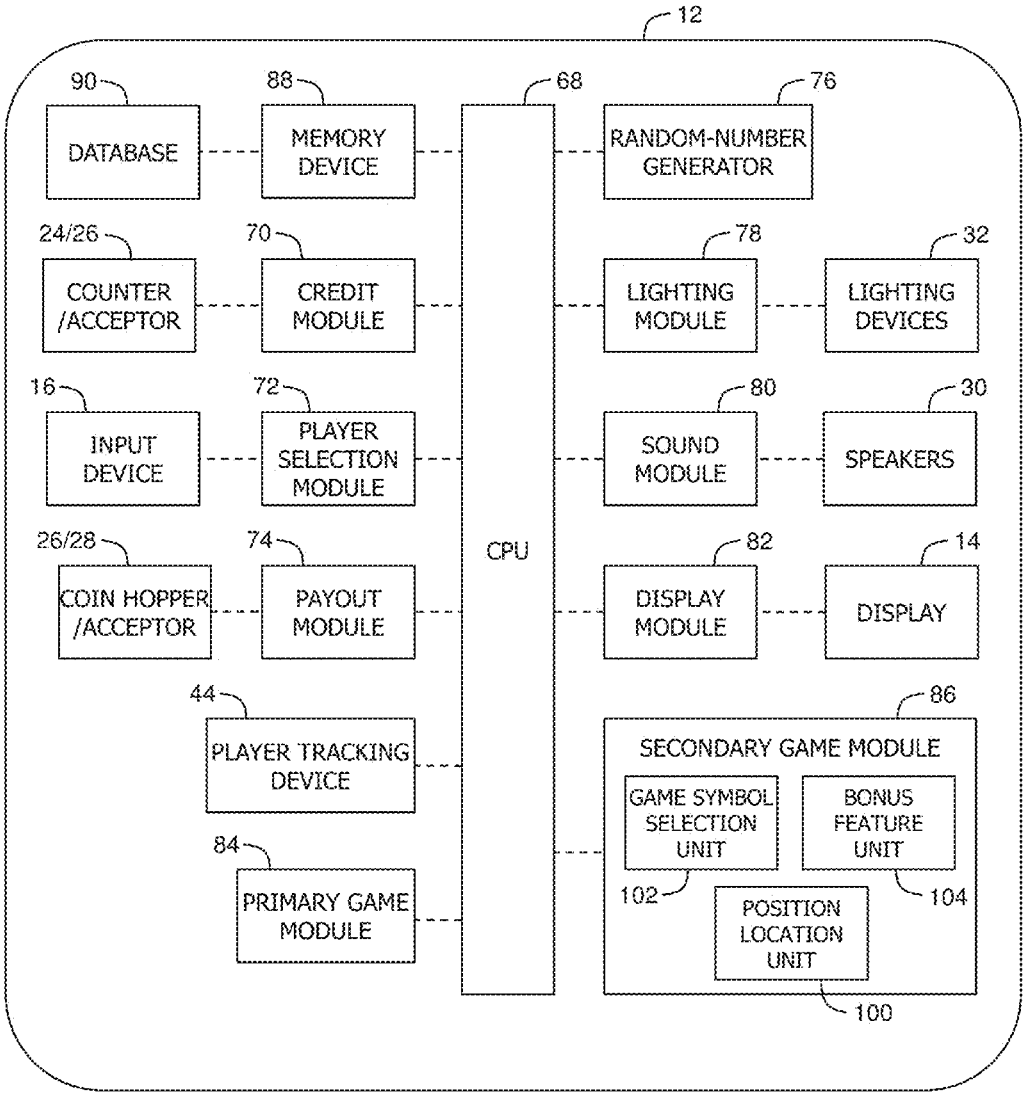
FIG. 2 is a schematic representation of a gaming controller that may be used with the gaming device shown in FIG. 1, according to an embodiment of the present invention.

FIG. 1 is a perspective view of an exemplary gaming device 10 for providing an award to a player, according to an embodiment of the present invention. FIG. 2 is a schematic representation of a gaming controller 12 that may be used with the gaming device 10. In the illustrated embodiment, the gaming device 10 includes a display device 14 for displaying a plurality of games, a user input device 16 to enable a player to interface with the gaming device 10, and a gaming controller 12 that is operatively coupled to the display device 14 and the user input device 16 to enable a player to play games being displayed on the display device 14. In one embodiment, the gaming device 10 may include a gaming machine installed in a casino. In another embodiment, the gaming device 10 may include a personal computer, laptop, cell phone, smartphone, tablet computer, personal data assistant, and/or any suitable computing device.

In the illustrated embodiment, the gaming device 10 also includes a cabinet assembly 18 that is configured to support the display device 14, the user input device 16, and/or the gaming controller 12 from a gaming stand 20 and/or a supporting surface. The display device 14 and the user input device 16 are each coupled to the cabinet assembly 18 and are each accessible by the player. In one embodiment, the gaming controller 12 is positioned within the cabinet assembly 18. Alternatively, the gaming controller 12 may be separated from the cabinet assembly 18, and connected to components of the gaming device 10 through a network such as, for example, a LAN, a WAN, dial-in-connections, cable modems, wireless modems, and/or special high-speed ISDN lines. For example, in one embodiment, the gaming controller 12 may be located remotely with respect to the gaming device 10, or within one of the gaming device cabinet assembly 18.

The user input device 16 includes a plurality of input buttons 22, a coin slot 24, and/or a bill acceptor 26. The coin slot 24 includes an opening that is configured to receive coins and/or tokens deposited by the player into the gaming device 10. The gaming controller 12 converts a value of the coins and/or tokens to a corresponding amount of gaming credits that are used by the player to wager on games played on the gaming device 10.

The bill acceptor 26 includes an input and output device that is configured to accept a bill, a ticket, and/or a cash card into the bill acceptor 26 to enable an amount of gaming credits associated with a monetary value of the bills, ticket, and/or cash card to be credited to the gaming device 10. Moreover, the gaming device 10 may also utilize a cashless wagering system (not shown), such as a ticket in ticket out (TITO) system (not shown). In one embodiment, the bill acceptor 26 also includes a printer (not shown) that is configured to dispense a printed voucher ticket that includes information indicative of an amount of credits and/or money paid out to the player by the gaming device 10 during a gaming session. The voucher ticket may be used at other gaming devices, or redeemed for cash, and/or other items as part of a casino cashless system (not shown).

A coin hopper 28 is coupled to the cabinet assembly 18 and is configured to receive a plurality of coins that are dispensed from the gaming device 10. One or more speakers 30 are installed inside the cabinet assembly 18 to generate voice announcements and/or sound effects associated with game play. The gaming device 10 also includes one or more lighting devices 32 that are configured to blink and/or change brightness and color in specific patterns to produce lighting effects to enhance a visual gaming experience for the player.

In one embodiment, the input buttons 22 include a plurality of BET switches 34 for inputting a wager on a game, a plurality of selection switches 36 for selecting a betting line, a payline, and/or card, a MAXBET switch 38 for inputting a maximum wager, a PAYOUT switch 40 for ending a gaming session and dispensing accumulated gaming credits to the player, and a start switch, i.e., a SPIN/DEAL button 42 to initiate an output of a game.

In the illustrated embodiment, the BET switches 34 include five switches from 1BET to 5BET to enable a player to wager between a minimum bet up to 5× minimum bet. Each selection switch 36 corresponds to a betting line such as, for example, a payline and/or symbol for a reel game, one or more cards for a card game, and/or a symbol for a roulette game, to enable a player to associate a wager with one or more betting lines. The MAXBET switch 38 enables a player to input the maximum bet that a player can spend against one play of a game. The PAYOUT switch 40 enables a player to receive the amount of money and/or credits awarded to the player during a gaming session, which has been credited onto the gaming device 10.

The gaming device 10 also includes a player tracking device 44 that is coupled to the gaming controller 12 for identifying the player and/or a player tracking account that is associated with the player. The player tracking account may include, but is not limited to, gaming credits available to the player for use in playing the gaming device 10. The player tracking device 44 is configured to communicate player account information between a player tracking controller (not shown) and the gaming device 10. For example, the player tracking device 44 may be used to track bonus points and/or credits awarded to the player during a gaming session and/or track bonus and/or credits downloaded to the gaming device 10 from the player tracking system. In the illustrated embodiment, the player tracking controller assigns a player status, e.g. a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking device 44 is coupled to the gaming cabinet assembly 18 and includes a player identification card reader 46, a data display 48, and a keypad 50. The player identification card reader 46 is configured to accept a player tracking card (not shown) inserted by the player, and read information contained on the player tracking card to identify the player account information. The player identification card reader 46 may include, but is not limited to, a barcode reader, a magnetic card reader, and/or a radio frequency identification (RFID) card reader. The keypad 50 is configured to accept a user selection input such as, for example, a unique player personal identification number (PIN) to facilitate enabling the gaming device 10 to identify the player, and access player account information associated with the identified player to be displayed on the data display 48. In one embodiment, the data display 48 includes a touchscreen panel that includes the keypad 50. Alternatively, the data display 48 and the keypad 50 may be included in the display device 14.

In the illustrated embodiment, the display device 14 is configured to display a game 52 on a game screen 54 (shown in FIGS. 4-7) including indicia and/or symbols for use in the game 52, e.g., cards used by a card game, roulette wheel and symbols used in a roulette game, reels used in a reel game and/or symbols and images used in a maze-type game or role-playing game. The game 52 may include any type of game including, but not limited to, a role-playing game, a puzzle game, a maze-type game, a video slot game, a keno game, a blackjack game, a video poker game, or any type of game which allows a player to make a wager, play a game, and potentially provide the player an award based on an outcome of the game and a paytable. In one embodiment, the display device 14 may include a first display 56 and a second display 58. Moreover, each display 56 and 58 may be configured to display at least a portion of the game screen 54 and/or bonus award feature screen 60. In one embodiment, the display device 14 may be configured to display a primary game 62 on the first display 56 and display a secondary game 64 on the second display 58. In addition, the display device 14 may be configured to display the secondary game 64 and a bonus feature game 66 (shown in FIG. 7) on the first display 56 and/or the second display 58.

In one embodiment, the first display 56, and/or the second display 58 may include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 14 and as the user input device 16. In an alternative embodiment, the first display 56 and/or the second display 58 may include a plurality of mechanical reels displaying a plurality of game symbols.

Referring to FIG. 2, in one embodiment, the gaming controller 12 may include a processor, i.e., a central processing unit (CPU) 68, a credit module 70, a player selection module 72, a payout module 74, a random-number generator (RNG) 76, a lighting module 78, a sound module 80, a display module 82, a primary game module 84, a secondary game module 86, a memory device 88, and a database 90. The memory device 88 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 68 to store, retrieve, and/or execute instructions and/or data.

The CPU 68 executes various programs, and thereby controls other components of the gaming controller 12 according to player instructions and data accepted by the user input device 16. The CPU 68 in particular executes a game program, and thereby conducts a game in accordance with the embodiments described herein. The memory device 88 stores programs and databases used by the CPU 68. Moreover, the memory device 88 stores and retrieves information in the database 90 including, but not limited to, wagers, wager amounts, average wagers per game, a game type, awards, type of awards, a number of reels associated with a game, a number of symbols being displayed on each reel, secondary game symbols, position locations, image data for producing game images and/or screens on the display device 14, and temporarily stores variables, parameters, and the like that are used by the CPU 68. In addition, the memory device 88 stores indicia, symbol weights, symbol values, paytables, and/or winning combination tables which represent relationships between combinations of random numbers and types of awards. In one embodiment, the memory device 88 utilizes RAM to temporarily store programs and data necessary for the progress of the game, and EPROM to store, in advance, programs and data for controlling basic operation of the gaming device 10, such as the booting operation thereof.

The credit module 70 manages the amount of player's credits, which is equivalent to the amount of coins and bills counted and validated by the bill acceptor 26. The player selection module 72 monitors player selections received through the input buttons 22, and accepts various instructions and data that a player enters through the input buttons 22. The payout module 74 converts a player's credits to coins, bills, or other monetary data by using the coin hopper 28 and/or for use in dispensing a credit voucher via the bill acceptor 26.

The lighting module 78 controls one or more lighting devices 32 to blink and/or change brightness and color in specific patterns in order to produce lighting effects associated with game play. The sound module 80 controls the speakers 30 to output voice announcements and sound effects during game play.

The display module 82 controls the display device 14 to display various images on a graphical interface including the game screen 54 preferably by using computer graphics and image data stored in the memory device 88. More specifically, the display module 82 controls video reels being displayed with the primary game 62 and secondary game symbols and images being displayed with the secondary game 64 and/or the bonus feature game 66 in the game screen 54 displayed on the first display 56 and/or the second display 58 by using computer graphics and the image data. In another embodiment, the display device 14 includes a plurality of mechanical reels. The display module 82 is configured to control a rotation of each of the plurality of mechanical reels to spin and stop each reel to display a game outcome.

The RNG 76 generates and outputs random numbers to the CPU 68 preferably at the start of each round of a game. The CPU 68 uses the random numbers to determine an outcome of the games. For example, if the game is a video slot game, the CPU 68 uses the RNG 76 to randomly select an arrangement of symbols to be displayed on video reels. Moreover, the CPU 68 generally uses random numbers generated by the RNG 76 to play the games and to determine whether or not to provide an award to a player. In one embodiment, the CPU 68 may also use the random numbers to determine a stop position of each reel for use in stopping each of a plurality of mechanical reels being displayed in the display device 14 to display the game outcome. The CPU 68 may also receive combinations of random numbers from the RNG 76 and compare the generated combinations with winning combinations stored in the winning combination table to determine if the generated outcome is a winning outcome that is associated with a type of award. In general, the term "award" may be a payout, in terms of credits or money. Thus, the CPU 68 may award a regular payout in response to the outcome of the game 52. However, it should be noted that the term award may also refer to other types of awards, including, prizes, e.g., meals, show tickets, etc. . . . , as well as in-game award, such as bonus features, free games, and/or free spins, or awarding the player one or more wild symbols or stacked wild symbols in each of the games.

The primary game module 84 includes a game program for use in executing the primary game 62 being displayed on the display device 14. In the illustrated embodiment, the primary game 62 is a video slot game. However, it should be noted that the primary game 62 may be any type of game upon which a player could make a wager including, but not limited to a keno game, a blackjack game, a video poker game, or any type of game that enables the gaming controller 12 to function as described herein. During play of the primary game 62, the primary game module 84 retrieves image data from the database 90 and displays the primary game 62 including a plurality of reels, each being displayed with the plurality of symbols. The primary game module 84 receives one or more wagers from the player via the user input device 16, responsively generates and outcome of the primary game 62, determines if the game outcome is a winning outcome, and provides an award to the player, if any, as a function of game outcome and the wager. Moreover, the primary game module 84 receives one or more random numbers from the RNG 76, determines an outcome of the primary game 62 as a function of the received random numbers, and spins and stops the reels to display the outcome of the primary game 62 on the display device 14.

The secondary game module 86 includes a game program for use in executing the secondary game 64 and/or the bonus feature game 66. In the illustrated embodiment, the secondary game module 86 is configured to display a secondary game 64 including a maze-type game that includes a game board 92 having a plurality of position locations 94 that are defined along a plurality of paths 96. In addition, the secondary game module 86 is configured to display a player symbol 98 (represented by a "Star" symbol in FIGS. 5 and 6) that is moved along the game board 92 between position locations 94 and along the plurality of paths 96. In one embodiment, the secondary game module 86 allows the player to move the player symbol 98 within the game board 92 in response to signals received via the user input device 16. In another embodiment, the secondary game module 86 moves the player symbol 98 within the game board 92 without input from the player. For example, in one embodiment, the secondary game module 86 may select a direction in which to move the player symbol 98 and/or select a position location 94 in which to move the player symbol 98 based on random numbers received from the RNG 76.

In the illustrated embodiment, the secondary game module 86 detects a triggering condition occurring with primary game 62 and initiates the secondary game 64 in response to detecting the triggering condition. In one embodiment, the triggering condition may be a mystery trigger condition that may occur after any bought game and/or any primary game outcome initiated based on a wager received from the player. For example, in one embodiment, the gaming controller 12 may randomly select a secondary game number from a predefined range of numbers. Upon receiving a wager for the player, the gaming controller 12 may randomly select a primary game number from the predefined range of numbers and initiate the secondary game if the primary game number matches the secondary game number. At the completion of the secondary game, the gaming controller 12 randomly selects another secondary game number from the predefined set of numbers for use in initiating subsequent secondary game. If the primary game number does not match the secondary game number, the gaming controller 12 randomly selects another primary game number when another wager associated with another primary game outcome is received from the player. In another embodiment, the gaming controller 12 may detect the triggering condition based on the appearance of one or more predefined game symbols, for example a scatter symbol, and/or a predefined combination of game symbols appearing in the primary game outcome. In addition, the triggering condition may be detected as a function of the amount of a current wager, a cumulative amount of wagers placed by the player, a level of play, player ranking, and/or any suitable triggering condition that enables the gaming controller 12 to function as described herein.

In the illustrated embodiment, the secondary game module 86 includes a position location unit 100, a game symbol selection unit 102, and a bonus feature unit 104. The position location unit 100 selects a number of position locations 94 being displayed with the secondary game 64. In one embodiment, the position location unit 100 may select a predefined number of position locations 94 being displayed with the secondary game 64. In another embodiment, the position location unit 100 may randomly select a number of position locations 94 being displayed with the secondary game 64. In addition, the position location unit 100 retrieves a previous player symbol location from the database that is indicative of the position location of the player symbol 98 at the conclusion of a previous secondary game 64 and determines the current position of the player symbol 98 based on the previous player location retrieved from the database 90.

In the illustrated embodiment, the game symbol selection unit 102 is configured to select one or more game symbols 106 from a predefined set of game symbols 106 for use with the secondary game 64 and associate each game symbol 106 with a corresponding position location 94. Each of the selected game symbols 106 is indicative of one or more actions that may be initiated by the gaming controller 12 such as, for example, providing an award to the player, initiating the bonus feature game 66, terminating and/or completing the secondary game 64, and/or any suitable action that may be initiated by the gaming controller 12.

Figure 5:
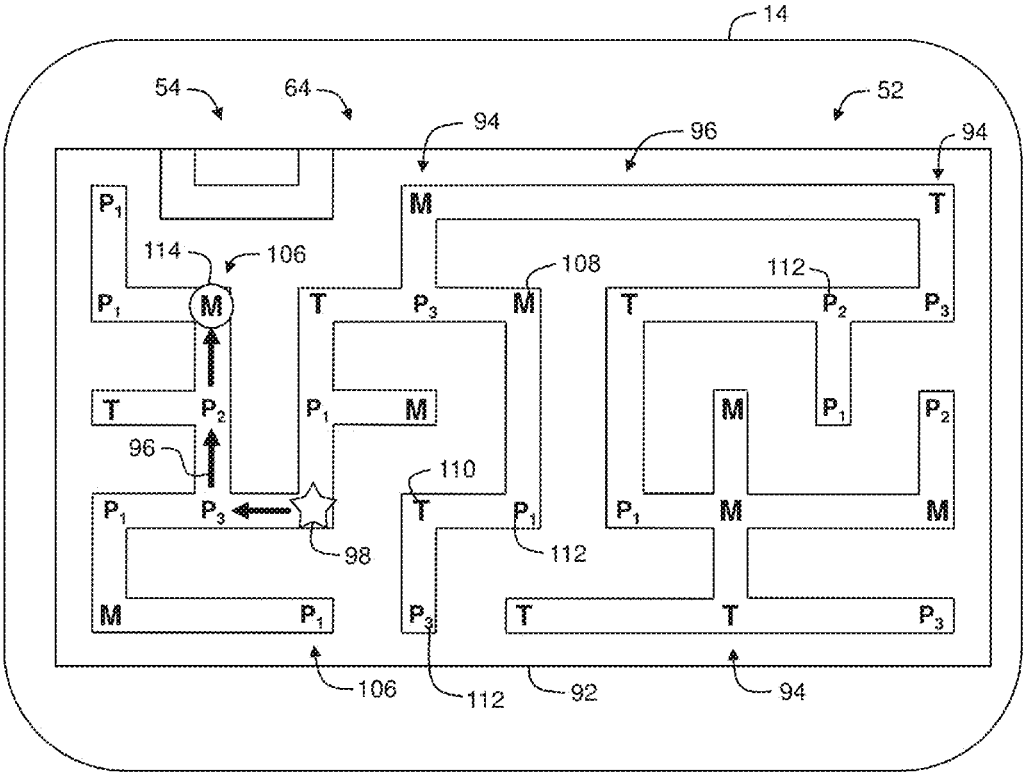
FIGS. 5 and 6 are exemplary entertaining graphical displays of a game screen including a secondary game that may be displayed in the gaming device shown in FIG. 1, according to an embodiment of the present invention.
Figure 6:
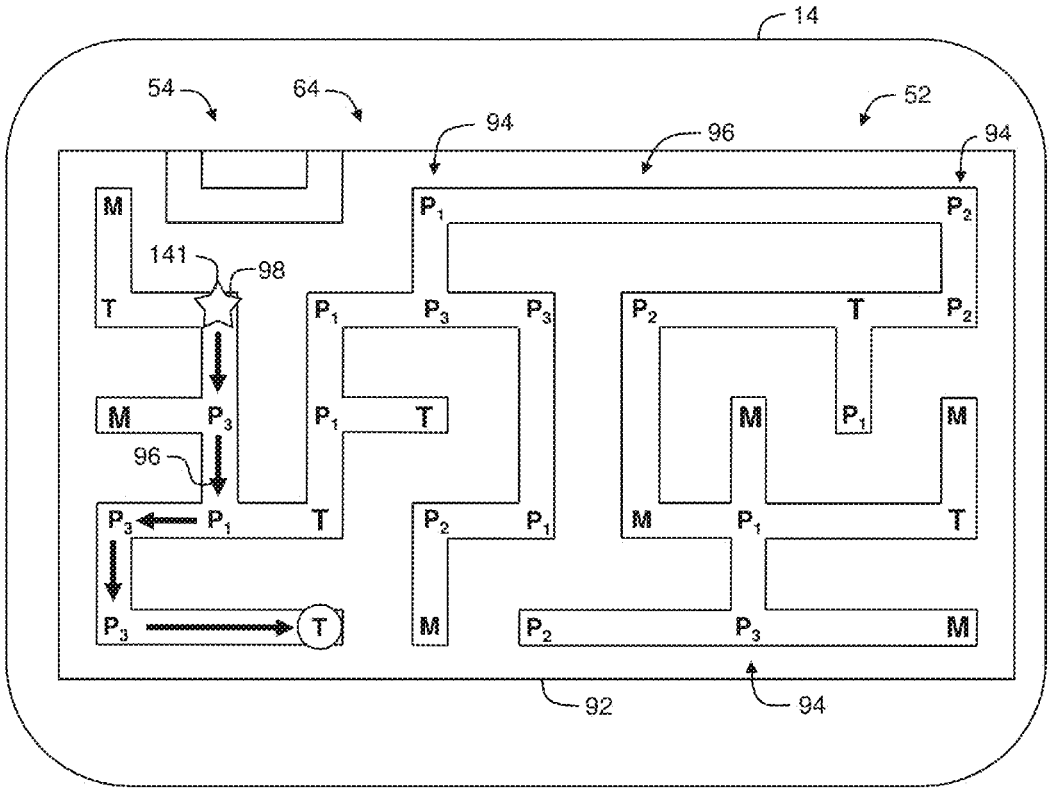

For example, in the illustrated embodiment, referring to FIGS. 5 and 6, the game symbols 106 are selected from a predefined set of game symbols that includes a bonus feature event symbol 108 (represented by the symbol "M") indicative of the bonus feature game 66, a termination symbol 110 (represented by the "T" symbol) indicative of a completion of the secondary game 64, and a prize award symbol 112 (represented by the "P" symbol) indicative of one or more prize awards. In one embodiment, the predefined set of game symbols may include a plurality of prize award symbols 112 that are indicative of a plurality of prize awards each having a different award value, such as, for example a different credit award value, number of free spins, number of addition game moves, and/or any suitable award. During play of the secondary game 64, the player symbol 98 is moved along a path 96 to a selected position location 94. The secondary game module 86 determines the game symbol 106 associated with the selected position location 94 and initiates the action associated with the corresponding game symbol 106.

In one embodiment, for each position location 94, the game symbol selection unit 102 may randomly select a game symbol 106 from the predefined set of game symbols 106 and associated the selected game symbol 106 with the corresponding position location 94. Moreover, each game symbol 106 in the predefined set of game symbols may include an associated selection probability. In one embodiment, each game symbol 106 may include a different selection probability. In another embodiment, each game symbol 106 may include a selection probability based on a number of position locations being displays with the secondary game. In addition, each game symbol 106 may have a selection probability determined as function of a wager amount and/or a number of secondary games 64 being awarded to the player.

For example, the probability of selecting a game symbol 106 associated with the number of position locations 94 may be provided as in the following chart.

| | Probability of Selecting a Game Symbol Number of Position Locations in Secondary Game | | | | |
|---|---|---|---|---|---|
| Game Symbol | n | n + 1 | n + 2 | n + 10 | n + 20 |
| Bonus Feature Game, M | 10% | 5% | 10% | 10% | 5% |
| Termination Symbol, T | 40% | 45% | 40% | 30% | 15% |
| Low Prize Award, $P_1$ | 30% | 20% | 30% | 40% | 40% |
| Med. Prize Award, $P_2$ | 15% | 20% | 10% | 15% | 30% |
| High Value Prize Award, $P_3$ | 5% | 10% | 10% | 5% | 10% |

The first column represents the game symbols 106 included in the predefined set of game symbols for use with the secondary game 64. The second column represents the probabilities of selecting each game symbol 106 associated with a number of position locations being equal to n. The third, fourth, fifth, and sixth columns represent the probability of selecting each game symbol 106 associated with a number of position locations being equal to n+1, n+2, n+10, and n+20, respectively. For example, in one embodiment, the secondary game module 86 may determine the number of position locations 94 being included in secondary game 64 and randomly select the game symbols 106 being associated with each of the position location 94 based on the selection probabilities that are determine as a function of the number of position locations 94.

The bonus feature unit 104 is configured to initiate a bonus feature game 66 in response to detecting the player symbol 98 being moved to a position location 94 being associated with a bonus feature event symbol 108. In addition, if the player symbol 98 is moved to the bonus feature event symbol 108, the secondary game module 86 completes and/or terminates the secondary game 64, stores the current player position 114 in the database for use in a subsequent secondary game 64, and initiates the bonus feature event game 66. The bonus feature unit 104 includes a game program for use in executing the bonus feature game 66 that is associated with one or more bonus awards 116. During the bonus feature game 66, the bonus feature unit 104 selects a set of bonus awards for use during the bonus feature game 66. The set of bonus awards includes an initial award value such as, for example, an initial number of game credits. The bonus feature unit 104 also enables the player to increase the award value of the set of bonus awards by obtaining winning outcomes during a role-playing game. For example, in one embodiment, the bonus feature game 66 includes a role-playing game during which the player may compete against one or more enemies to access a set of bonus awards having a higher award value. During play of the bonus feature game 66, the bonus feature unit 104 displays one or more enemy symbols 118 on a game display area 120, selects an enemy symbol number that is associated with the enemy symbol 118, and selects a player number associated with the player. The bonus feature unit 104 may determine the player number to be greater than or equal to the enemy number, determine that the player has achieved a winning result, for example the player has defeated the enemy symbol 118, and increase the award value of the set of bonus awards. In addition, upon achieving the winning result, the bonus feature unit 104 may select and display another enemy symbol 118, and select another enemy number and another player number to determine if another winning result is obtained.

If the bonus feature unit 104 determines that the selected player number is less than the selected enemy number, the bonus feature unit 104 concludes the bonus feature event, randomly selects a bonus award from the set of bonus awards having an associated current award value and provides the player with the selected bonus award. The gaming controller 12 then allows the player to continue playing the primary game 62.

Figure 3:
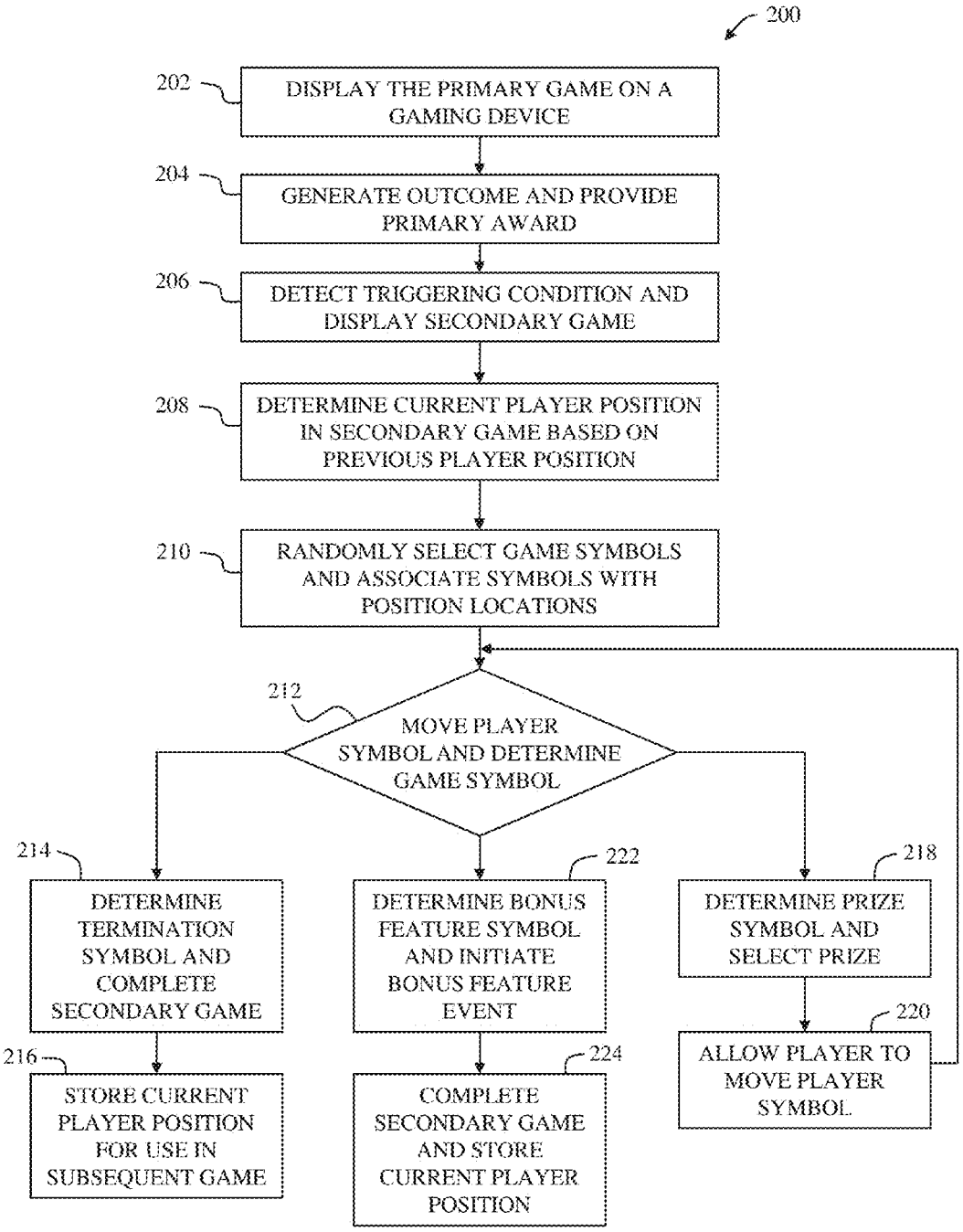
FIG. 3 is a flowchart of a method that may be used with the gaming device shown in FIG. 1 for providing an award to a player, according to an embodiment of the present invention.
Figure 4:
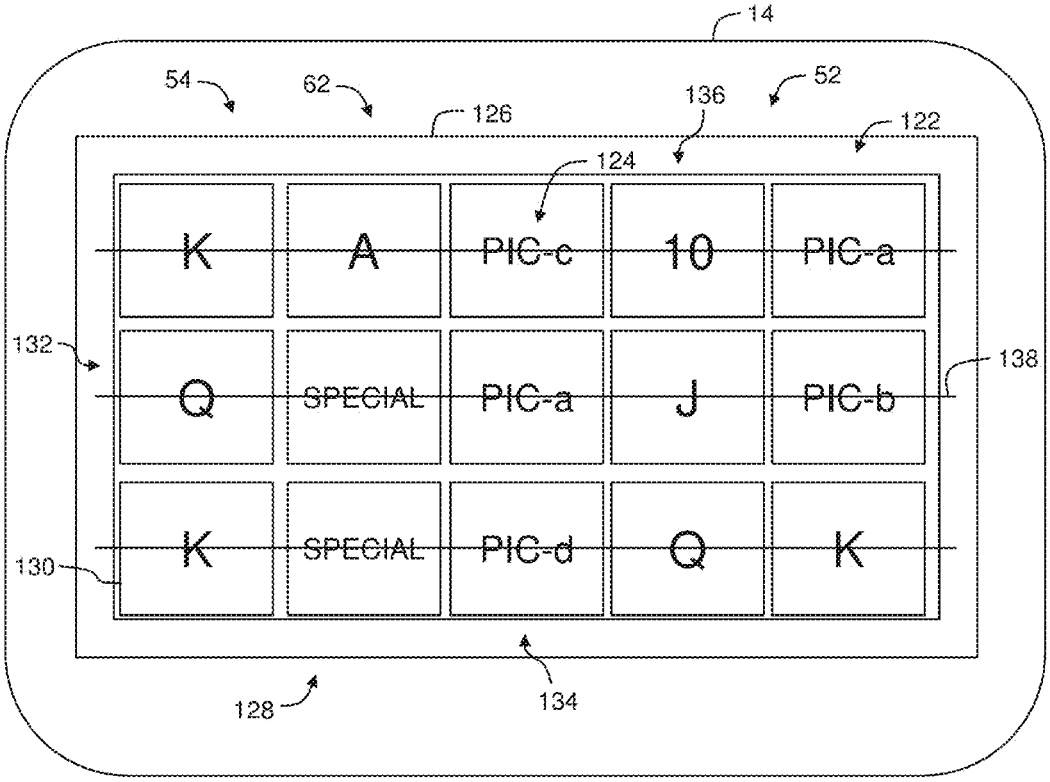
FIG. 4 is an exemplary entertaining graphical display of a game screen including a primary slot-type game that may be displayed on the gaming device shown in FIG. 1, according to an embodiment of the present invention.
Figure 7:
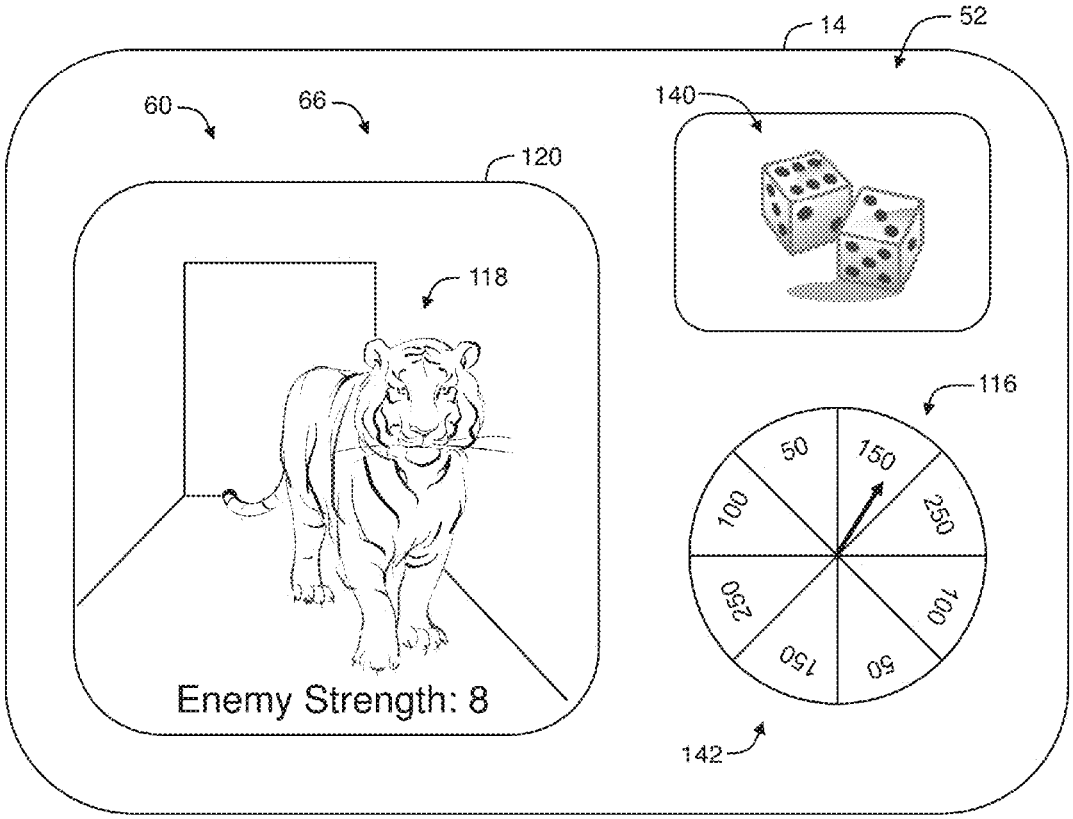
FIG. 7 is exemplary entertaining graphical display of a game screen including a bonus feature event that may be displayed in the gaming device shown in FIG. 1, according to an embodiment of the present invention.

FIG. 3 is a flowchart of a method 200 that may be used with the gaming device 10 to provide an award to a player. The method 200 includes a plurality of steps. Each method step may be performed independently of, or in combination with, other method steps. Portions of the method 200 may be performed by any one of, or any combination of, the components of the one or more gaming devices 10. FIG. 4 is an exemplary entertaining graphical display of the primary game 62 that may be played with the gaming device 10. FIGS. 5 and 6 are exemplary entertaining graphical displays of the secondary game 64 that may be played on the gaming device 10. FIG. 7 is exemplary entertaining graphical display of the bonus feature game 66 that may be displayed with the gaming device 10.

In the illustrated embodiment, in method step 202, the gaming controller 12 receives a signal indicative of a wager being received by the gaming device 10 and responsively displays the primary game 62 on the display device 14. In one embodiment, the primary game 62 is a video slot game. However, it should be noted that the game 52 may be any type of game upon which a player could make a wager including, but not limited to a keno game, a blackjack game, a video poker game, or any type of game that enables the gaming controller 12 to function as described herein. In addition, in one embodiment, the game 52 may include a slot game being displayed with a plurality of mechanical reels (not shown). In the illustrated embodiment, the gaming controller 12 displays the primary game 62 on the first display 56. In another embodiment, the gaming controller 12 displays the primary game 62 on the first display 56 and/or the second display 58.

In method step 204, the gaming controller 12 randomly generates an outcome 122 of the primary game 62 and displays the generated game outcome 122 in the game screen 54. The gaming controller 12 randomly selects a plurality of primary game symbols 124 from a predefined set of possible game symbols, and displays the selected primary game symbols 124 associated with the generated game outcome 122 in the game screen 54. In the illustrated embodiment, the plurality of primary game symbols 124 are displayed in a display area 126 that includes a grid 128 having a plurality of cells 130 arranged along a plurality of rows 132 and a plurality of columns 134. Each cell 130 displays one or more primary game symbols 124 associated with the game outcome 122. In the illustrated embodiment, the gaming controller 12 displays the primary game symbols 124 within a plurality of reels 136. Each reel 136 is associated with a corresponding column 134. The game 62, in the illustrated embodiment, includes 5 reels 136 with 3 cells per reel, respectively (a "5×3" arrangement) displayed in the display area 126. Alternatively, other reel arrangements may be used such as, for example, 3-4-3-4-3, 4-5-5-5-4, or 4-5-4-5-4 arrangements or arrangements with the same number of cells per column, such as 3×3, 3×4, 4×5, or 5×5 configurations. The primary game 62 may also include a plurality of paylines 138 that extend across one or more cells 130 to indicate, to the player, a combination of primary game symbols 124.

In the illustrated embodiment, the gaming controller 12 receives a signal, from the user input device 16, that is indicative of a player's selection to initiate a gaming session including a wager amount, and a selection of one or more paylines 138 associated with a predefined set of cells 130 within the display area 126. In the illustrated embodiment, the game 62 is a multi-line game, i.e., the paylines include horizontal paylines and/or diagonal pay-lines, and/or zig-zag paylines. Moreover, the user input device 16 may allow the player to toggle to increase the bet per payline a credit at a time (up to the maximum bet). The gaming controller 12 randomly generates an outcome of the primary game 62, and displays the generated outcome 122 on the game screen 54. In one embodiment, the gaming controller 12 is configured to rotate, and/or spin each reel 136 to initiate a game play, and stop each reel 136 to display a plurality of primary game symbols 124 associated with the randomly generated outcome 122. In addition, the gaming controller 12 is adapted to determine if the generated outcome 122 is a winning outcome as a function of the displayed primary game symbols 124, a paytable, a wager, and one or more player selected paylines 138. More specifically, the gaming controller 12 determines if a combination of symbols 124 arranged along the selected payline 138 is a winning combination. The gaming controller 12 may provide an award in response to the outcome of the game 62.

Each primary game 62 is generally played in a conventional manner. The player makes a wager, which may be based on a predetermined denomination and a selected number of paylines 138, the gaming controller 12 randomly generates an outcome for the game 62, spins the reels 136, and selectively stops the reels 136 to display a primary game symbol 124 in each of the display cells 130. If a predetermined pattern of primary game symbols 124 is randomly chosen for each cell 130 on a played payline 138, the player may be awarded a payout based on the payline, the wager, and a predetermined paytable. Moreover, the player may be awarded a payout if the combination of primary game symbols 124 associated with a selected payline 138 is a winning combination. In addition, a player may receive a bonus feature, bonus games, and/or free games based on the combination of primary game symbols 124 associated with the selected payline 138 and/or the appearance of one or more special game symbols in the game outcome 122. Many variations to the above described general play of a slot game fall within the scope of the present invention. Such slot games are well-known in the art, and are therefore not further discussed.

In method step 206, the gaming controller 12 detects the occurrence of a triggering condition during the primary game 62 and initiates the secondary game 64 (shown in FIGS. 5-7) in response to detecting the triggering condition. In the illustrated embodiment, the triggering condition is mystery trigger condition that may be detected after any primary game outcome. The gaming controller 12 may randomly select a secondary game number from a predefined range of numbers and, upon receiving a wager from the player, the gaming controller 12 randomly selects a primary game number detects the triggering condition if the primary game number matches the secondary game number. In one embodiment, the triggering condition may be defined as a winning combination being formed along a selected payline. In another embodiment, the triggering condition may include an appearance of one or more special symbols being displayed in the outcome of the primary game 62. In another embodiment, the gaming controller 12 may define the triggering condition as a predefined amount of wagering credits being placed as a wager during the primary game 62 and/or a predefined number of primary games being played by the player.

In the illustrated embodiment, the gaming controller 12 displays the secondary game 64 including a game board 92 being displayed in the game screen 54 and a plurality of paths 96 being displayed on the game board 92 including a plurality of position locations 94. In one embodiment, the gaming controller 12 displays the secondary game including a predefined number of position locations 94. In another embodiment, the gaming controller 12 randomly selects a number of position locations 94 and displays the selected number of position locations 94 on the game board 92.

In method step 208, the gaming controller 12 determines a current player position 114 within the game board 92 and responsively displays a player symbol 98 at the current player position 114. The current player position 114 is associated with one of the plurality of position locations 94 and is indicative of a previous position location 141 of the player symbol (represented by a "Circle" symbol in FIG. 5) at a completion of a previous secondary game 64. In the illustrated embodiment, the gaming controller 12 retrieves the previous player symbol location from the database 90 and determines the current player position 114 based on the previous player position. More specifically, the gaming controller 12 determines the position location 94 associated with the player symbol 98 at the completion of the previous secondary game 64 and displays the player symbol 98 at the previous position location 141.

In method step 210, the gaming controller 12 randomly selects a plurality of secondary game symbols 106 from a predefined set of game symbols and associates the selected secondary game symbols 106 with each of the plurality of position locations 94. In the illustrated embodiment, the predefined set of game symbols includes the bonus feature event symbol 108 (represented by the symbol "M") indicative of the bonus feature game 66, the termination symbol 110 (represented by the "T" symbol) indicative of a completion of the secondary game 64, and one or more prize award symbols 112 (represented by the "$P_n$" symbol) indicative of one or more prize awards. In the illustrated embodiment, the gaming controller 12 randomly selects a secondary game symbol 106 for each of the number of position locations 94 being displayed in the game board 92. In another embodiment, the gaming controller 12 may randomly select a number of each of the secondary game symbols 108, 110, and 112, and randomly assign each selected secondary game symbol 106 to one of the position locations 94. For example, in one embodiment, the gaming controller 12 randomly selects each of a first number of bonus feature event symbols 108, a second number of termination symbols 110, and a third number of prize award symbols 112 for use with the secondary game 64. In the illustrated embodiment, the secondary game symbols 106 are not initially displayed on the game board 92 such that the location of the secondary game symbols 106 are not visible to the player.

In method step 212, the gaming controller 12 allows the player to select a position location 94 and responsively moves the player symbol 98 from the current player position to the selected position location 94 in response to player input received from the user input device 16. In the illustrated embodiment, the player is allowed to move the player symbol 98 to an adjacent position location 94 located along one or more adjacent paths 96. In another embodiment, the player is allows to move the player symbol 98 to any position location 94 within the game board. In one embodiment, the gaming controller 12 may randomly select a position location 94 and move the player symbol 98 to the randomly selected position location 94 on behalf of the player. In the illustrated embodiment, the gaming controller 12 determines the game symbol 106 that is associated with the selected position location 94 and provide a secondary award, if any, to the player as a function of the associated secondary game symbol 106. In addition, the gaming controller 12 displays the secondary game symbol 106 associated with the selected position location upon moving the player symbol 98 to the selected position location 94 such that the associated secondary game symbol 106 is visible to the player.

In method step 214, the gaming controller 12 determines if the secondary game symbol 106 associated with the selected position location 94 is a termination symbol 110 and responsively concludes the current secondary game 64 and returns game play to the primary game 62.

In method step 216, upon determining that the player has selected the termination symbol 110, the gaming controller 12 identifies the current position location of the player symbol 98 and stores the current player position 114 in the database 90 for use in a subsequent secondary game 64.

In method step 218, the gaming controller 12 determines if the secondary game symbol 106 associated with the selected position location 94 is a prize symbol 112 and responsively provides the player a prize award associated with the prize symbol 112. In one embodiment, the secondary game 64 may include a plurality of prize symbols 112 associated with the position locations including a first prize symbol having a first prize award value and a second prize symbol having a second prize award value that is different than the first prize award value. Upon selecting a prize symbol 112 the gaming controller 12 may determine the prize award value associated with the prize symbol 112 and provide the player with the determined prize award. In another embodiment, the prize symbol 112 may be associated with a plurality of awards and the gaming controller 12 may randomly select an award from the associated plurality of awards and provide the player with the selected award.

In method step 220, upon determining that the player has selected a prize symbol 112, the gaming controller 12 allows the player to select another position location 94 and returns to method step 212 and moves the player symbol 98 to the selected position location 94.

In method step 222, the gaming controller 12 determines if the secondary game symbol 106 associated with the selected position location 94 is a bonus feature event symbol 108 and responsively initiates the bonus feature game 66. During a round of the bonus feature game 66, the gaming controller 12 displays an enemy symbol 118. The gaming controller 12 randomly selects a first enemy symbol number from a predefined range of numbers, and randomly select a first player number from the predefined range of numbers. In one embodiment, the gaming controller 12 may select a predefined enemy symbol number that is indicative of a relative strength and/or number of previous enemy symbols 118 that have been displayed. In another embodiment, the gaming controller 12 may randomly select the enemy symbol number. In addition, the gaming controller 12 may display one or more dice 140 that are rotated and stopped to simulate rolling dice for use in displaying the selected player number during each round of the bonus feature game 66.

The bonus feature game 66 allows the player to be awarded a bonus award 116 from a set of bonus awards 142 having associated award values. During play of the bonus feature game 66, the gaming controller 12 determines that the player has defeated the enemy symbol 118 if the selected player number is greater than or equal to the enemy symbol number, and responsively increase a value of the associated award values of the set of bonus awards 116. The gaming controller 12 may also display another enemy symbol, select a second enemy symbol number from the predefined range of numbers, and randomly select a second player number from the predefined range of numbers. In addition, in one embodiment, the gaming controller 12 may provide the player an option to choose between selecting an award from the set of bonus awards or continuing play in the bonus feature game 66. If the player elects to select an award, the gaming controller 12 randomly selects a bonus award from the current set of bonus award values, provides the selected award to the player and concludes the bonus feature game 66.

In addition, the gaming controller 12 may also determine if the player number is less than the enemy symbol number and responsively select the bonus award from the set of bonus awards including the corresponding award values and concludes the bonus feature game 66.

In method step 224, upon the conclusion of the bonus feature game 66, the gaming controller 12 completes the secondary game 64, identifies the current position location of the player symbol 98, stores the current player position 114 in the database 90 for use in a subsequent secondary game 64, and returns game play to the primary game 62.

Figure 8:
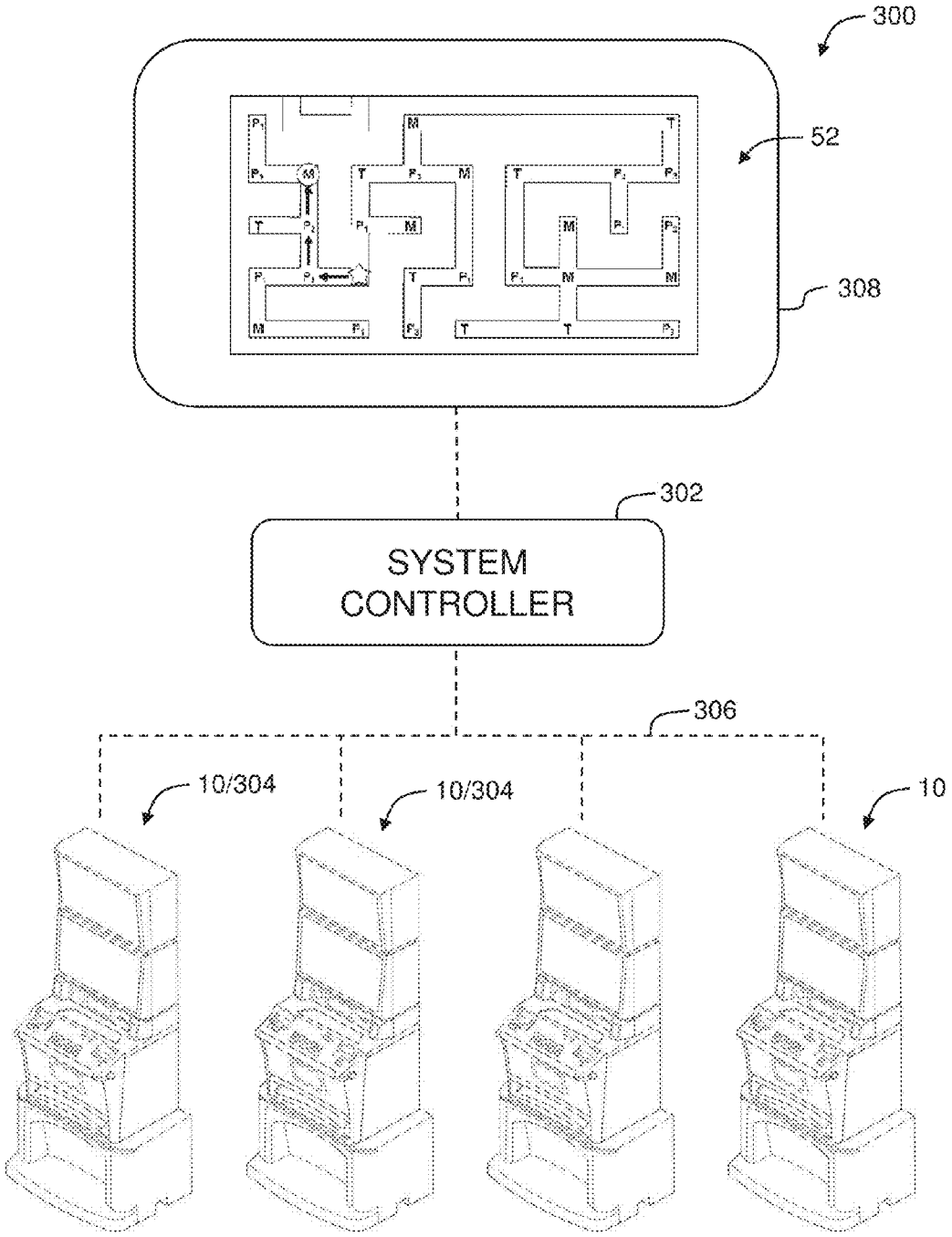
FIG. 8 is a schematic view of a gaming system that may be used for providing an award to a player, according to an embodiment of the present invention.

FIG. 8 is a schematic view of an exemplary gaming system 300. The gaming system 300 includes a system controller 302 and one or more gaming devices 10 that are coupled to the system controller 302. In one embodiment, the gaming devices 10 include a gaming machine 304 located in a casino. In another embodiment, the gaming devices 10 may include a personal computer, laptop, cell phone, smartphone, tablet computer, personal data assistant, and/or any suitable computing device that enables a player to connect to system controller 302 via the internet.

In the illustrated embodiment, the system controller 302 is configured to perform all of the functions of the gaming controller 16 as described herein. The system controller 302 communicates with each gaming device 10 for playing a primary game 62 and/or a secondary game 64 on each gaming device 10 based on user selection input received from each gaming device 10. In the illustrated embodiment, the system controller 302 plays a separate instance of the games on each gaming device 10 such that each player associated with the gaming devices 10 may play a separate instance of the games simultaneously.

In one embodiment, the system 300 includes a plurality of gaming machines 304 located in a casino. The gaming machines 304 and the system controller 302 are coupled in communication with a local area network (LAN) 306. Alternatively, the gaming machines 304 and the system controller 302 may be coupled via a network such as, for example, an Internet link, an intranet, a WAN, dial-in-connections, cable modems, wireless modems, and/or ISDN lines. In the illustrated embodiment, the gaming system 300 includes four gaming machines 304, which in one embodiment as shown in FIG. 8 are arranged in a bank, i.e., are arranged together, adjacently. It should be noted, however, that the gaming system 300 may include any number of gaming machines 304 that may be arranged in any manner, such as in a circle or along a curved arc, or positioned within separate areas of a casino floor, and/or separate gaming establishments such as different casinos. Furthermore, additional groups of gaming machines 304 may be coupled to the system controller 302. In addition, in the illustrated embodiment, the gaming system 300 may also include a central display 308 that is coupled to the system controller 302 for displaying games played on one or more of the gaming machines 304.

In one embodiment, the system controller 302 may be implemented by one of the gaming controllers 12 associated with a gaming machine 304. In still another embodiment, the system controller 302 may be located remotely with respect to gaming machines 304, or within one of the gaming machine cabinet assemblies (shown in FIG. 1).

In the illustrated embodiment, the system controller 302 may be configured to play separate instances of the primary game 62 on each of the gaming machine 304. In addition, the system controller 302 may determine if a triggering condition occurs in a game outcome being played at one or more of the gaming machines 304, and display the secondary game 64 on the central display 308 if a triggering event occurs. Alternatively, the system controller 302 may display the secondary game 64 at one or more gaming machines 304 based on one or more triggering events occurring in games played at the gaming machines 304.

The above-described system, apparatus, and methods overcome at least some disadvantages of known gaming systems by providing a gaming device that provides a bonus game that allows a player to interact with a player symbol to select one or more bonus awards and that increased the probability of winning an award by providing persistent player positions with subsequent bonus games. Moreover, the gaming device provides a game that includes a plurality of game symbols positioned throughout a game maze and allows a player to move a player symbol through the game maze to acquire game symbols. The gaming device also provides an award to the player as a function of the acquired game symbols. In addition, upon completion of the bonus game, the gaming device stores the current location of the player symbol for use in a subsequent bonus game. By providing a bonus game that includes a plurality of game symbols that are acquired by the player to obtain associated awards, and that stores the location of the corresponding player symbol for use in subsequent games, the probability of the player receiving an award is increased. Thus, the amount of time that the gaming devices are played by patrons of a gaming establishment is thereby increased.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing

What is claimed is:

1. A gaming device, comprising:

a display device for displaying a game, the display device including a first display and a second display;

a user input device for receiving input from a player; and a controller coupled to the display device and the user input device, the controller configured to:

display a primary game on the first display of the display device, the primary game including a plurality of reels and a plurality of symbols being displayed with the plurality of reels;

randomly generate an outcome of the primary game and display the outcome on the first display;

detect a triggering condition occurring with the primary game and responsively display a current instance of a secondary game on the second display of the display device including a game board having a plurality of paths and a plurality of position locations defined along each of the plurality of paths;

determine a current player position within the game board and responsively display a player symbol at the current player position, the current player position being associated with one of the plurality of position locations, the current player position being indicative of a previous position location of the player symbol at a completion of a previous instance of the secondary game, wherein the previous instance of the secondary game includes a first set of game symbols that are associated with the plurality of position locations;

randomly select a second set of game symbols and associate the selected second set of game symbols with the plurality of position locations of the current instance of the secondary game;

receive player input via the input device to allow the player to select a position location of the plurality of position locations and responsively move the player symbol from the current player position to the selected position location in response to player input received from the user input device;

determine a game symbol associated with the selected position location; and upon determining the game symbol associated with the selected position location is a bonus feature event symbol, responsively initiate a bonus feature game by:

displaying the bonus feature game on the second display of the display device including game display area displaying an enemy symbol;

selecting a first enemy number from a predefined range of numbers; and randomly selecting a first player number from the predefined range of numbers;

displaying a die on the on the second display and animating the die simulating a rolling die to display the selected first player number;

determining if the selected first player number is less than the selected first enemy number and responsively randomly selecting a bonus award from a set of bonus awards and provide the selected bonus award to the player; and completing the current instance of the secondary game and storing the current player position in a database for use in a subsequent instance of the secondary game.

2. A gaming device in accordance with claim 1, the controller configured to:

display a progressive wheel on the second display including the set of bonus awards and animate the wheel to notify the player of the randomly selected bonus award.

3. A gaming device in accordance with claim 1, the controller configured to:

initiate the subsequent instance of the secondary game; and randomly select a third set of game symbols and associate the third set of game symbols with the plurality of position locations of the subsequent instance of the secondary game.

4. A gaming device in accordance with claim 1, the controller configured to display the game symbol associated with the selected position location upon moving the player symbol to the selected position location.

5. A gaming device in accordance with claim 1, the controller configured to randomly select a number of position locations being displayed with the current instance of the secondary game; and randomly select the second set of symbols as a function of the randomly selected number of position locations.

6. A gaming device in accordance with claim 1, the set of game symbols including the bonus feature symbol indicative of the bonus feature event award, a termination symbol indicative of the completion of the secondary game, and a prize award symbol indicative of one of a plurality of a prize awards.

7. A gaming device in accordance with claim 6, the controller configured to:

randomly select each of a first number of bonus feature symbols, a second number of termination symbols, and a third number of prize award symbols being used with the secondary game.

8. A gaming device in accordance with claim 6, the controller configured to:

determine if the game symbol associated with the selected position location is a termination symbol and responsively complete the current instance of the secondary game and store the current player position in a database for use in a subsequent instance of the secondary game.

9. A gaming device in accordance with claim 6, the controller configured to:

determine if the game symbol associated with the selected position location is a prize symbol and responsively provide the player a prize award associated with the prize symbol; and allow the player to move the player symbol to another selected position location.

10. A gaming device in accordance with claim 9, wherein the secondary game includes a plurality of prize symbols associated with the position locations, the plurality of prize symbols including a first prize symbol having a first prize award value and a second prize symbol having a second prize award value that is different than the first prize award value.

11. A gaming device in accordance with claim 1, the controller configured to:

complete the current instance of the secondary game and store the current player position in a database for use in a subsequent instance of the secondary game.

12. A gaming device in accordance with claim 11, wherein the set of bonus awards includes associated award values, the controller configured to:

determine if the selected first player number is greater than the first enemy number, responsively increase a value of the associated award values of the set of bonus awards, and display another enemy symbol;

select a second enemy number from the predefined range of numbers; and randomly select a second player number from the predefined range of numbers; and determine if the second player number is less than the second enemy number and responsively select the bonus award from the set of bonus awards including the increased associated award values.

13. A method of operating a gaming machine, the gaming machine including a display device for displaying a game, a user input device for receiving input from a player, and a controller includes a processor, the method including the processor performing the steps of:

displaying a primary game on a first display of the display device, the primary game including a plurality of reels and a plurality of symbols being displayed with the plurality of reels;

randomly generating an outcome of the primary game and displaying the outcome on the first display;

detecting a triggering condition occurring with the primary game and responsively displaying a current instance of a secondary game on a second display of the display device including a game board having a plurality of paths and a plurality of position locations defined along each of the plurality of paths;

determining a current player position within the game board and responsively displaying a player symbol at the current player position, the current player position being associated with one of the plurality of position locations, the current player position being indicative of a previous position location of the player symbol at a completion of a previous instance of the secondary game, wherein the previous instance of the secondary game includes a first set of game symbols that are associated with the plurality of positions locations;

randomly selecting a second set of game symbols and associate the selected second set of game symbols with the plurality of position locations of the current instance of the secondary game receiving player input via the input device to allow the player to select a position location of the plurality of position locations and responsively moving the player symbol from the current player position to the selected position location in response to player input received from the user input device;

determining a game symbol associated with the selected position location; and upon determining the game symbol associated with the selected position location is a bonus feature event symbol, responsively initiating a bonus feature game by:

displaying the bonus feature game on the second display of the display device including game display area displaying an enemy symbol;

selecting a first enemy number from a predefined range of numbers; and randomly selecting a first player number from the predefined range of numbers;

displaying a die on the on the second display and animating the die simulating a rolling die to display the selected first player number;

determining if the selected first player number is less than the selected first enemy number and responsively randomly selecting a bonus award from a set of bonus awards and providing the selected bonus award to the player; and completing the current instance of the secondary game and store the current player position in a database for use in a subsequent instance of the secondary game.

14. A method in accordance with claim 13, including the steps of:

initiating the subsequent instance of the secondary game; and randomly selecting a third set of game symbols and associating the third set of game symbols with the plurality of position locations of the subsequent instance of the secondary game.

15. A method in accordance with claim 13, the set of game symbols including the bonus feature symbol indicative of the bonus feature event award, a termination symbol indicative of the completion of the secondary game, and a prize award symbol indicative of one of a plurality of a prize awards.

16. A method in accordance with claim 15, including the steps of:

determining if the game symbol associated with the selected position location is a termination symbol and responsively completing the current instance of the secondary game and storing the current player position in a database for use in a subsequent instance of the secondary game.

17. A method in accordance with claim 15, including the steps of:

determining if the game symbol associated with the selected position location is a prize symbol and responsively providing the player a prize award associated with the prize symbol; and allowing the player to move the player symbol to another selected position location.

18. A method in accordance with claim 15, including the steps of:

determining if the selected first player number is greater than the first enemy number and responsively increasing value of the associated award values of the set of bonus awards, displaying another enemy symbol, selecting a second enemy number from the predefined range of numbers, randomly selecting a second player number from the predefined range of numbers, and determining if the second player number is less than the second enemy number, and responsively selecting the bonus award from the set of bonus awards including the increased associated award values.

19. One or more non-transitory computer-readable storage media, having computer-executable instructions for operating a gaming machine embodied thereon, the gaming machine including a display device for displaying a game, a user input device for receiving input from a player, and a controller including at least one processor, wherein when executed by the at least one processor, the computer-executable instructions cause the at least one processor to:

display a primary game on a first display of the display device, the primary game including a plurality of reels and a plurality of symbols being displayed with the plurality of reels;

randomly generate an outcome of the primary game and display the outcome on the first display;

detect a triggering condition occurring with the primary game and responsively display a current instance of a secondary game on a second display of the display device including a game board having a plurality of paths and a plurality of position locations defined along each of the plurality of paths;

determine a current player position within the game board and responsively display a player symbol at the current player position, the current player position being associated with one of the plurality of position locations, the current player position being indicative of a previous position location of the player symbol at a completion of a previous instance of the secondary game, wherein the previous instance of the secondary game includes a first set of game symbols that are associated with the plurality of position locations;

randomly select a second set of game symbols and associate the selected second set of game symbols with the plurality of position locations of the current instance of the secondary game receive player input via the input device to allow the player to select a position location of the plurality of position locations and responsively move the player symbol from the current player position to the selected position location in response to player input received from the user input device;

determine a game symbol associated with the selected position location; and upon determining the game symbol associated with the selected position location is a bonus feature event symbol, responsively initiate a bonus feature game by:

displaying the bonus feature game on the second display of the display device including game display area displaying an enemy symbol;

selecting a first enemy number from a predefined range of numbers; and randomly selecting a first player number from the predefined range of numbers;

displaying a die on the on the second display and animating the die simulating a rolling die to display the selected first player number;

determining if the selected first player number is less than the selected first enemy number and responsively randomly selecting a bonus award from a set of bonus awards and provide the selected bonus award to the player; and completing the current instance of the secondary game and storing the current player position in a database for use in a subsequent instance of the secondary game.

20. The one or more computer-readable storage media according to claim 19, the computer-executable instructions cause the processor to:

initiate the subsequent instance of the secondary game; and randomly select a third set of game symbols and associate the third set of game symbols with the plurality of position locations of the subsequent instance of the secondary game.

* * * * *